US011043166B2

(12) United States Patent
Ko et al.

(10) Patent No.: US 11,043,166 B2
(45) Date of Patent: Jun. 22, 2021

(54) PIXEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-Si (KR)

(72) Inventors: Yoomin Ko, Suwon-si (KR); Gun Hee Kim, Seoul (KR); Sang Hoon Kim, Seoul (KR); Taehoon Yang, Yongin-si (KR); Joohee Jeon, Hwaseong-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/896,573

(22) Filed: Jun. 9, 2020

(65) Prior Publication Data

US 2021/0012707 A1 Jan. 14, 2021

(30) Foreign Application Priority Data

Jul. 9, 2019 (KR) ..... 10-2019-0082375

(51) Int. Cl.
*G09G 3/325* (2016.01)
*G09G 3/3291* (2016.01)
*G09G 3/3266* (2016.01)

(52) U.S. Cl.
CPC ..... *G09G 3/325* (2013.01); *G09G 3/3266* (2013.01); *G09G 3/3291* (2013.01); *G09G 2300/0852* (2013.01)

(58) Field of Classification Search
CPC .... G09G 3/325; G09G 3/3266; G09G 3/3291; G09G 2300/0852; G09G 2300/0819; G09G 3/3233; G09G 3/3241; G09G 2310/0251
USPC ..... 345/76
See application file for complete search history.

(56) References Cited

U.S. PATENT DOCUMENTS

| | | | | |
|---|---|---|---|---|
| 8,842,231 | B2 | 9/2014 | Liu et al. | |
| 9,305,494 | B2 * | 4/2016 | Shim | G09G 3/3291 |
| 9,530,800 | B2 | 12/2016 | Wang et al. | |
| 10,566,406 | B2 * | 2/2020 | Kim | H01L 27/3258 |
| 10,909,921 | B2 * | 2/2021 | Hwang | G09G 3/3258 |
| 10,916,196 | B2 * | 2/2021 | Moon | G09G 3/3291 |
| 2006/0055336 | A1 * | 3/2006 | Jeong | G09G 3/3233 315/169.3 |
| 2014/0333680 | A1 * | 11/2014 | Choi | H05B 45/60 345/690 |

(Continued)

*Primary Examiner* — Tom V Sheng
(74) *Attorney, Agent, or Firm* — Cantor Colburn LLP

(57) ABSTRACT

A pixel of an organic light emitting diode ("OLED") display device includes a switching transistor which transfers a data voltage, a storage capacitor which stores the data voltage transferred by the switching transistor, a driving transistor which generates a driving current based on the data voltage stored in the storage capacitor, an emission control transistor which selectively forms a path for the driving current in response to an emission control signal, an OLED which emits light based on the driving current, and a supplemental electrode overlapping a gate electrode of the driving transistor, the supplemental electrode having a first voltage for a predetermined time period from a time point at which the emission control signal has a turn-on level, and having a second voltage after the predetermined time period.

20 Claims, 10 Drawing Sheets

(56) References Cited

U.S. PATENT DOCUMENTS

| | | | | |
|---|---|---|---|---|
| 2015/0255523 | A1* | 9/2015 | Her | G09G 3/3233 345/76 |
| 2015/0372070 | A1* | 12/2015 | Yoon | H01L 27/3258 257/40 |
| 2016/0064411 | A1* | 3/2016 | Park | H01L 27/156 257/89 |
| 2016/0079330 | A1* | 3/2016 | Oh | H01L 27/3262 257/40 |
| 2018/0130418 | A1* | 5/2018 | Zhu | G09G 3/3258 |
| 2020/0243023 | A1* | 7/2020 | Fan | G09G 5/10 |
| 2020/0342814 | A1* | 10/2020 | Teraguchi | H01L 27/3248 |

* cited by examiner

PIXEL OF AN ORGANIC LIGHT EMITTING DIODE DISPLAY DEVICE, AND ORGANIC LIGHT EMITTING DIODE DISPLAY DEVICE

This application claims priority to Korean Patent Application No. 10-2019-0082375, filed on Jul. 9, 2019, and all the benefits accruing therefrom under 35 U.S.C. § 119, the content of which in its entirety is herein incorporated by reference.

BACKGROUND

1. Field

Exemplary embodiments of the invention relate to a display device, and more particularly to a pixel of an organic light emitting diode ("OLED") display device, and the OLED display device.

2. Description of the Related Art

A pixel of an organic light emitting diode ("OLED") display device generally includes an OLED, a storage capacitor for storing a data voltage, a driving transistor for driving the OLED based on the data voltage stored in the storage capacitor, and at least one switching transistor for controlling an operation of the pixel.

Recently, a technique that disposes a supplemental electrode under the driving transistor has been developed in order to block light (e.g., infrared light) output from a sensor under the pixel or in order to increase a driving current.

SUMMARY

A parasitic capacitor may be provided by a supplemental electrode. Due to the parasitic capacitor, step efficiency that a pixel emits light with luminance lower than desired luminance at a light emission start time point and then emits the light with the desired luminance after a predetermined period of time may occur.

Some exemplary embodiments provide a pixel of an organic light emitting diode ("OLED") display device capable of preventing step efficiency.

Some exemplary embodiments provide an OLED display device capable of preventing step efficiency.

In an exemplary embodiment, there is provided a pixel of an OLED display device. The pixel includes a switching transistor which transfers a data voltage, a storage capacitor which stores the data voltage transferred by the switching transistor, a driving transistor which generates a driving current based on the data voltage stored in the storage capacitor, an emission control transistor which selectively forms a path for the driving current in response to an emission control signal, an OLED which emits light based on the driving current, and a supplemental electrode overlapping a gate electrode of the driving transistor, the supplemental electrode having a first voltage for a predetermined time period from a time point at which the emission control signal has a turn-on level, and having a second voltage after the predetermined time period.

In an exemplary embodiment, the first voltage may be a voltage for reducing an effect of a first parasitic capacitor between the supplemental electrode and the gate electrode of the driving transistor and an effect of a second parasitic capacitor between the supplemental electrode and an active region of the driving transistor.

In an exemplary embodiment, the first voltage may be a voltage for shifting a threshold voltage of the driving transistor in a negative direction.

In an exemplary embodiment, the first voltage may be a negative voltage, and the second voltage may be a positive voltage.

In an exemplary embodiment, the predetermined time period may have a time length of one horizontal time.

In an exemplary embodiment, the storage capacitor may include a first electrode connected to a line of a control signal, and a second electrode, the driving transistor may have the gate electrode connected to the second electrode of the storage capacitor, a source electrode, and a drain electrode, the switching transistor may include a gate electrode receiving a scan signal, a source electrode receiving the data voltage, and a drain electrode connected to the second electrode of the storage capacitor, and the supplemental electrode may be disposed under the gate electrode of the driving transistor, and may be connected to the line of the control signal.

In an exemplary embodiment, the control signal may have the first voltage for the predetermined time period, and may have the second voltage after the predetermined time period.

In an exemplary embodiment, the emission control transistor may include a gate electrode receiving the emission control signal, a source electrode connected to the drain electrode of the driving transistor, and a drain electrode connected to the OLED.

In an exemplary embodiment, the emission control transistor may include a gate electrode receiving the emission control signal, a source electrode connected to the line of the control signal, and a drain electrode connected to the source electrode of the driving transistor.

In an exemplary embodiment, the storage capacitor may include a first electrode connected to a line of a power supply voltage, and a second electrode, the driving transistor may include the gate electrode connected to the second electrode of the storage capacitor, a source electrode, and a drain electrode, the switching transistor may include a gate electrode receiving a scan signal, a source electrode receiving the data voltage, and a drain electrode connected to the second electrode of the storage capacitor, and the supplemental electrode may be disposed under the gate electrode of the driving transistor, and may be connected to a line of a control signal.

In an exemplary embodiment, the storage capacitor may include a first electrode connected to a line of a control signal, and a second electrode, the driving transistor may include a first transistor including the gate electrode connected to the second electrode of the storage capacitor, a source electrode, and a drain electrode, the switching transistor may include a second transistor including a gate electrode receiving a scan signal, a source electrode receiving the data voltage, and a drain electrode connected to the source electrode of the first transistor, the emission control transistor may include a third transistor including a gate electrode receiving the emission control signal, a source electrode connected to the line of the control signal, and a drain electrode connected to the source electrode of the first transistor, and a fourth transistor including a gate electrode receiving the emission control signal, a source electrode connected to the drain electrode of the first transistor, and a drain electrode connected to the OLED, and the supplemental electrode may be disposed under the gate electrode of the first transistor, and may be connected to the line of the control signal.

In an exemplary embodiment, the pixel may further include a fifth transistor including a gate electrode receiving the scan signal, a source electrode connected to the drain electrode of the first transistor, and a drain electrode connected to the gate electrode of the first transistor, a sixth transistor including a gate electrode receiving an initialization signal, a source electrode connected to the second electrode of the storage capacitor, and a drain electrode connected to a line of an initialization voltage, and a seventh transistor including a gate electrode receiving the scan signal, a source electrode connected to the OLED, and a drain electrode connected to the line of the initialization voltage.

In an exemplary embodiment, the storage capacitor may include a first electrode connected to a line of a power supply voltage, and a second electrode, the driving transistor may include a first transistor including the gate electrode connected to the second electrode of the storage capacitor, a source electrode, and a drain electrode, the switching transistor may include a second transistor including a gate electrode receiving a scan signal, a source electrode receiving the data voltage, and a drain electrode connected to the source electrode of the first transistor, the emission control transistor may include a fifth transistor including a gate electrode receiving the emission control signal, a source electrode connected to the line of the power supply voltage, and a drain electrode connected to the source electrode of the first transistor, and a sixth transistor including a gate electrode receiving the emission control signal, a source electrode connected to the drain electrode of the first transistor, and a drain electrode connected to the OLED, the supplemental electrode may be disposed under the gate electrode of the first transistor, and may be connected to a line of a control signal. The pixel may further include a third transistor including a gate electrode receiving the scan signal, a source electrode connected to the drain electrode of the first transistor, and a drain electrode connected to the gate electrode of the first transistor, a fourth transistor including a gate electrode receiving an initialization signal, a source electrode connected to the second electrode of the storage capacitor, and a drain electrode connected to a line of an initialization voltage, and a seventh transistor including a gate electrode receiving the scan signal, a source electrode connected to the OLED, and a drain electrode connected to the line of the initialization voltage.

In an exemplary embodiment, there is provided a pixel of an OLED display device. The pixel includes an OLED including an anode electrode, and a cathode electrode connected to a line of a second power supply voltage, a storage capacitor including a first electrode connected to a line of a control signal, and a second electrode, a first transistor including a gate electrode connected to the second electrode of the storage capacitor, a source electrode, and a drain electrode, a second transistor including a gate electrode receiving a scan signal, a source electrode receiving a data voltage, and a drain electrode connected to the source electrode of the first transistor, a third transistor including a gate electrode receiving the scan signal, a source electrode connected to the drain electrode of the first transistor, and a drain electrode connected to the gate electrode of the first transistor, a fourth transistor including a gate electrode receiving an initialization signal, a source electrode connected to the second electrode of the storage capacitor, and a drain electrode connected to a line of an initialization voltage, a fifth transistor including a gate electrode receiving an emission control signal, a source electrode connected to the line of the control signal, and a drain electrode connected to the source electrode of the first transistor, a sixth transistor including a gate electrode receiving the emission control signal, a source electrode connected to the drain electrode of the first transistor, and a drain electrode connected to the anode electrode of the OLED, a seventh transistor including a gate electrode receiving the scan signal, a source electrode connected to the anode electrode of the OLED, and a drain electrode connected to the line of the initialization voltage, and a supplemental electrode which overlaps the gate electrode of the first transistor, and is connected to the line of the control signal. The control signal has a first voltage for a predetermined time period from a time point at which the emission control signal has a turn-on level, and has a second voltage after the predetermined time period.

In an exemplary embodiment, the first voltage may be a voltage for reducing an effect of a first parasitic capacitor between the supplemental electrode and the gate electrode of the first transistor and an effect of a second parasitic capacitor between the supplemental electrode and an active region of the first transistor.

In an exemplary embodiment, the first voltage may be a voltage for shifting a threshold voltage of the first transistor in a negative direction.

In an exemplary embodiment, the first voltage may be a negative voltage, and the second voltage may be a positive voltage.

In an exemplary embodiment, the first voltage may be the initialization voltage, and the second voltage may be a first power supply voltage.

In an exemplary embodiment, the predetermined time period may have a time length of one horizontal time.

In an exemplary embodiment, there is provided an OLED display device including a display panel including a plurality of pixels, a data driver which provides a data voltage to the plurality of pixels, a scan driver which provides a scan signal and a control signal to the plurality of pixels, and an emission driver which provides an emission control signal to the plurality of pixels. Each of the plurality of pixels includes a switching transistor, a storage capacitor, a driving transistor, an emission control transistor, an OLED, and a supplemental electrode which overlaps a gate electrode of the driving transistor and receives the control signal. The control signal has a first voltage for a predetermined time period from a time point at which the emission control signal has a turn-on level, and has a second voltage after the predetermined time period.

As described above, in a pixel of an OLED display device and the OLED display device, a supplemental electrode overlapping a gate electrode of a driving transistor may have a first voltage for a predetermined time period from a time point at which an emission control signal has a turn-on level, and may have a second voltage after the predetermined time period. Accordingly, step efficiency that the pixel emits light with luminance lower than desired luminance at a light emission start time point and then emits the light with the desired luminance after a predetermined period of time may be prevented.

BRIEF DESCRIPTION OF THE DRAWINGS

Illustrative, non-limiting exemplary embodiments will be more clearly understood from the following detailed description in conjunction with the accompanying drawings.

DETAILED DESCRIPTION

Figure 1:
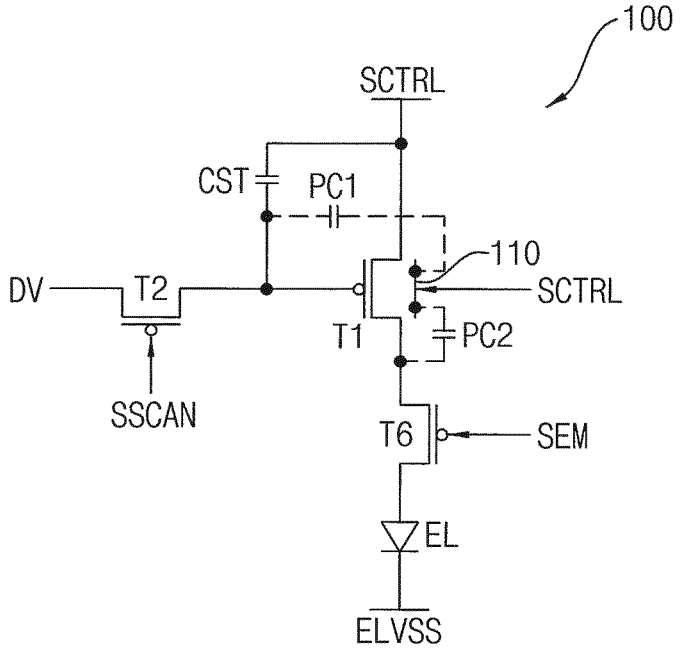
FIG. 1 is a circuit diagram illustrating an exemplary embodiment of a pixel of an organic light emitting diode ("OLED") display device.

Hereinafter, embodiments of the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. Further, an introducing order in this section may be different from that of claims due to antecedent basis problem. For example, "a fifth transistor" in this section could be "a third transistor" in a claim.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
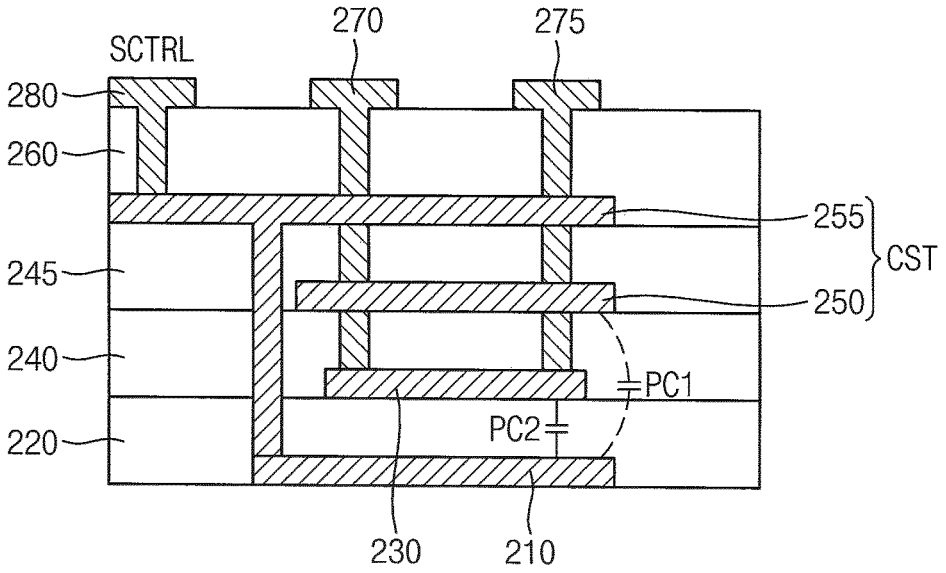
FIG. 2 is a cross-sectional diagram illustrating an exemplary embodiment of a portion of a pixel of an OLED display device.
Figure 3:
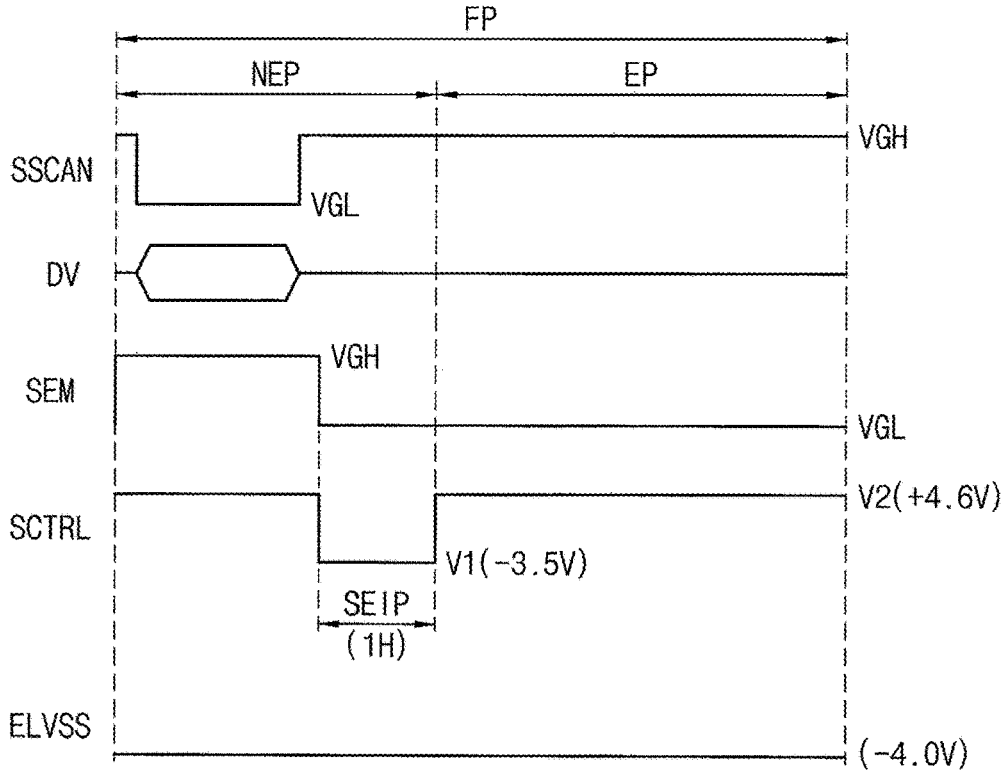
FIG. 3 is a timing diagram for describing an exemplary embodiment of an operation of a pixel of FIG. 1.

FIG. 1 is a circuit diagram illustrating an exemplary embodiment of a pixel of an organic light emitting diode ("OLED") display device, FIG. 2 is a cross-sectional diagram illustrating an exemplary embodiment of a portion of a pixel of an OLED display device, and FIG. 3 is a timing diagram for describing an exemplary embodiment of an operation of a pixel of FIG. 1.

Referring to FIG. 1, a pixel 100 of an OLED display device may include a storage capacitor CST, a switching transistor T2, a driving transistor T1, an emission control transistor T6, an OLED EL and a supplemental electrode 110.

The storage capacitor CST may store a data voltage DV transferred by the switching transistor T2. In some exemplary embodiments, the storage capacitor CST may include a first electrode connected to a line of a control signal SCTRL, and a second electrode connected to a drain electrode of the switching transistor T2 and a gate electrode of the driving transistor T1.

The switching transistor T2 may transfer the data voltage DV to the second electrode of the storage capacitor CST in response to a scan signal SSCAN. In some exemplary embodiments, the switching transistor T2 may include a gate electrode receiving the scan signal SSCAN, a source electrode receiving the data voltage DV, and the drain electrode connected to the second electrode of the storage capacitor CST.

The driving transistor T1 may generate a driving current based on the data voltage DV stored in the storage capacitor CST. In some exemplary embodiments, the driving transistor T1 may include the gate electrode connected to the second electrode of the storage capacitor CST, a source electrode connected to the line of the control signal SCTRL, and a drain electrode connected to a source electrode of the emission control transistor T6.

The emission control transistor T6 may selectively form a path through which the driving current flows in response to an emission control signal SEM. That is, the emission control transistor T6 may form the path for the driving current from the line of the control signal SCTRL to a line of a second power supply voltage (e.g., a low power supply voltage) ELVSS when the emission control signal SEM has a turn-on level (e.g., a level of a low gate voltage VGL in FIG. 3), and may block the path for the driving current when the emission control signal SEM has a turn-off level (e.g., a level of a high gate voltage VGH in FIG. 3). In some exemplary embodiments, the emission control transistor T6 may include a gate electrode receiving the emission control signal SEM, the source electrode connected to the drain electrode of the driving transistor T1, and a drain electrode connected to an anode electrode of the OLED EL.

The OLED EL may emit light based on the driving current generated by the driving transistor T1. In some exemplary embodiments, the OLED EL may include the anode electrode connected to the drain electrode of the emission control transistor T6, and a cathode electrode connected to the line of the second power supply voltage ELVSS.

The supplemental electrode 110 may overlap the gate electrode of the driving transistor T1, and may be connected to the line of the control signal SCTRL to receive the control signal SCTRL. In some exemplary embodiments, the supplemental electrode 110 may be disposed under the gate electrode of the driving transistor T1. Thus, in some exemplary embodiments, the supplemental electrode 110 may block light (e.g., infrared light) output from a light sensor (e.g., an infrared light sensor) disposed under the pixel 100 or the driving transistor T1 of the pixel 100. Further, in some exemplary embodiments, the supplemental electrode 110 may be used as a portion of the path for the driving current in addition to a channel region of the driving transistor T1, and thus luminance of the OLED EL may be increased. In some exemplary embodiments, the supplemental electrode 110 may include, but not be limited to, molybdenum (Mo). In other exemplary embodiments, the supplemental electrode 110 may include a low resistance opaque conductive material, such as aluminium (Al), Al alloy, tungsten (W), copper (Cu), nickel (Ni), chromium (Cr), titanium (Ti), platinum (Pt), tantalum (Ta), etc.

The supplemental electrode 110 may be disposed under the gate electrode of the driving transistor T1 such that the supplemental electrode 110 overlaps the gate electrode of the driving transistor T1. In an exemplary embodiment, as illustrated in FIG. 2, a buffer layer 220 for blocking an impurity of a substrate may be disposed on the supplemental electrode 110 or 210, for example. An active region 230, or the channel region of the driving transistor T1 may be disposed on the buffer layer 220. A first gate insulating layer 240 may be disposed on the active region 230 of the driving transistor T1 and the buffer layer 220. A first conductive electrode 250 may be disposed on the first gate insulating layer 240. The first conductive electrode 250 may be used as the gate electrode of the driving transistor T1 and the second electrode of the storage capacitor CST. A second gate insulating layer 245 may be disposed on the first conductive electrode 250 and the first gate insulating layer 240. A second conductive electrode 255 may be disposed on the second gate insulating layer 245. The second conductive electrode 255 may be used as the first second electrode of the storage capacitor CST. An interlayer insulating layer 260 may be disposed on the second conductive electrode 255 and the second gate insulating layer 245. The line 280 of the control signal SCTRL and the source and drain electrodes 270 and 275 of the driving transistor T1 may be disposed on the interlayer insulating layer 260. The source and drain electrodes 270 and 275 of the driving transistor T1 may be connected to the active region 230. The line 280 of the control signal SCTRL may be connected to the second conductive electrode 255, or the first electrode of the storage capacitor CST. The line 280 of the control signal SCTRL may be further connected to the supplemental electrode 110 or 210 through the second conductive electrode 255, or the first electrode of the storage capacitor CST. As described above, since the supplemental electrode 110 or 210 is disposed under the first conductive electrode 250, or the gate electrode of the driving transistor T1, the supplemental electrode 110 or 210 may block the light output from the light sensor, or may increase the luminance of the luminance of the OLED EL.

As illustrated in FIGS. 1 and 2, since supplemental electrode 110 or 210 is disposed under the first conductive electrode 250, or the gate electrode of the driving transistor T1, a first parasitic capacitor PC1 may be provided between the supplemental electrode 110 or 210 and the first conductive electrode 250 (i.e., the gate electrode of the driving transistor T1 or the second electrode of the storage capacitor CST), and a second parasitic capacitor PC2 may be provided between the supplemental electrode 110 or 210 and the active region 230 of the driving transistor T1. By the first and second parasitic capacitors PC1 and PC2, step efficiency that the pixel 100 emits light with luminance lower than desired luminance at a light emission start time point and then emits the light with the desired luminance after a predetermined period of time (e.g., one horizontal time (1H)) may occur.

However, in an exemplary embodiment of the pixel 100, based on the control signal SCTRL, the supplemental electrode 110 or 210 may have a first voltage for a predetermined time period (which may be referred to as a step efficiency improvement period) from a time point at which the emission control signal SEM has the turn-on level, and may have a second voltage after the predetermined time period. In some exemplary embodiments, the first voltage may be a negative voltage, and the second voltage may be a positive voltage. In an exemplary embodiment, the first voltage may range from about −1 volt (V) to about −5V, for example. Further, for example, the second voltage may be a first power supply voltage.

In an exemplary embodiment, as illustrated in FIG. 3, a frame period FP may include a non-emission period NEP and an emission period EP, for example. In the non-emission period NEP, the scan signal SSCAN may have the turn-on level, or the level of the low gate voltage VGL, and the emission control signal SEM may have the turn-off level, or the level of the high gate voltage VGH. While the scan signal SSCAN has the level of the low gate voltage VGL, the data voltage DV may be stored in the storage capacitor CST. Subsequently, the scan signal SSCAN may have the level of the high gate voltage VGH, and the emission control signal SEM may have the level of the low gate voltage VGL. When the emission control signal SEM has the turn-on level, or the level of the low gate voltage VGL, the control signal SCTRL may have the first voltage V1, for example, a negative voltage of about −3.5V for the predetermined time period. Here, the predetermined time period may be referred to as a step efficiency improvement period SEIP. In some exemplary embodiments, the step efficiency improvement period SEIP may have a time length of one horizontal time or longer.

During the step efficiency improvement period SEIP, since the control signal SCTRL having the first voltage V1 is applied to the supplemental electrode 110 or 210, the supplemental electrode 110 or 210 also may have the first voltage V1. When the emission control signal SEM has the turn-on level, the first conductive electrode 250, or the gate electrode of the driving transistor T1 may have a negative voltage, positive charges, or holes may be induced at an upper portion of the active region 230 of the driving transistor T1, and negative charges, or electrons may be induced at a lower portion of the active region 230 of the driving transistor T1. At this time, since the supplemental electrode 110 or 210 has the first voltage V1, or the negative voltage, the first parasitic capacitor PC1 between the supplemental electrode 110 or 210 and the first conductive electrode 250, or the gate electrode of the driving transistor T1 and the second parasitic capacitor PC2 between the supplemental electrode 110 or 210 and the active region 230 of the driving transistor T1 may be discharged, and thus effects of the first and second parasitic capacitors PC1 and PC2 may be reduced or eliminated. Further, even when a threshold voltage of the driving transistor T1 is shifted in a positive direction by the first and second parasitic capacitors PC1 and PC2, in some exemplary embodiments, the supplemental electrode 110 or 210 having the first voltage V1, or the negative voltage may allow the threshold voltage of the driving transistor T1 to be shifted again in a negative direction. Accordingly, after the step efficiency improvement period SEIP, the control signal SCTRL may have the second voltage V2, or a positive voltage (e.g., the first power supply voltage of about +4.6V), and the pixel 100 may emit the light with the desired luminance without the step efficiency. Further, in some exemplary embodiments, as illustrated in FIG. 3, the second power supply voltage ELVSS may have, but not be limited to, a voltage level of about −4.0V, for example.

As described above, in the pixel 100 of the OLED display device, the supplemental electrode 110 or 210 overlapping the gate electrode of the driving transistor T1 may have the first voltage V1 (e.g., the negative voltage) for the predetermined time period, i.e., the step efficiency improvement period SEIP, from the time point at which the emission control signal SEM has the turn-on level, and may have the second voltage V2 (e.g., the positive voltage) after the predetermined time period, i.e., the step efficiency improvement period SEIP. Accordingly, the step efficiency that the pixel 100 emits light with luminance lower than desired luminance at a light emission start time point and then emits the light with the desired luminance after a predetermined period of time may be prevented.

Figure 4:
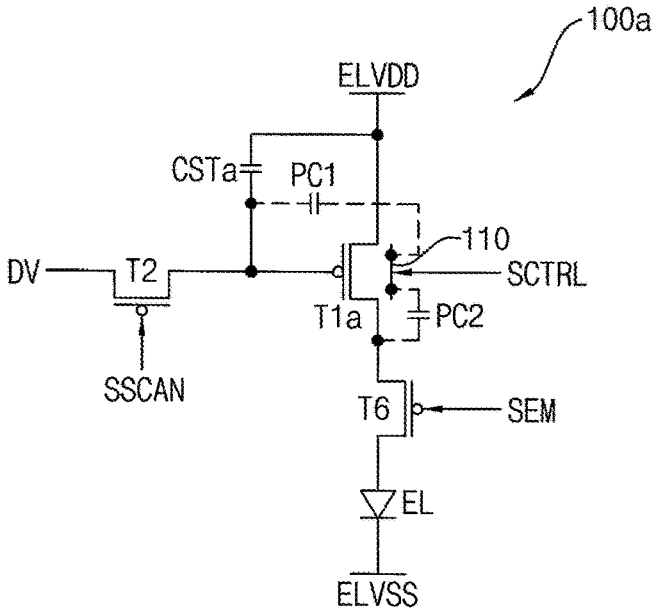
FIG. 4 is a circuit diagram illustrating an exemplary embodiment of a pixel of an OLED display device.
Figure 5:
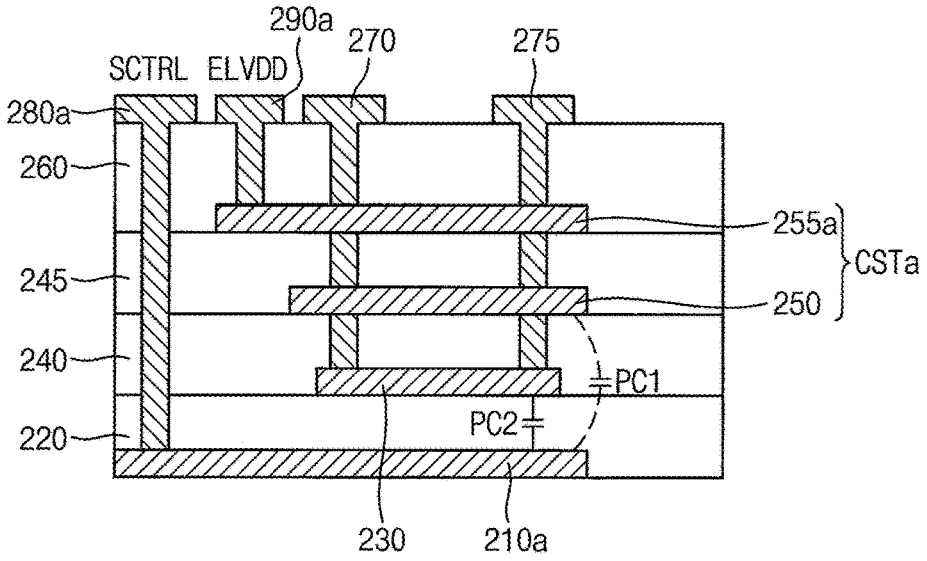
FIG. 5 is a cross-sectional diagram illustrating an exemplary embodiment of a portion of a pixel of an OLED display device.
Figure 6:
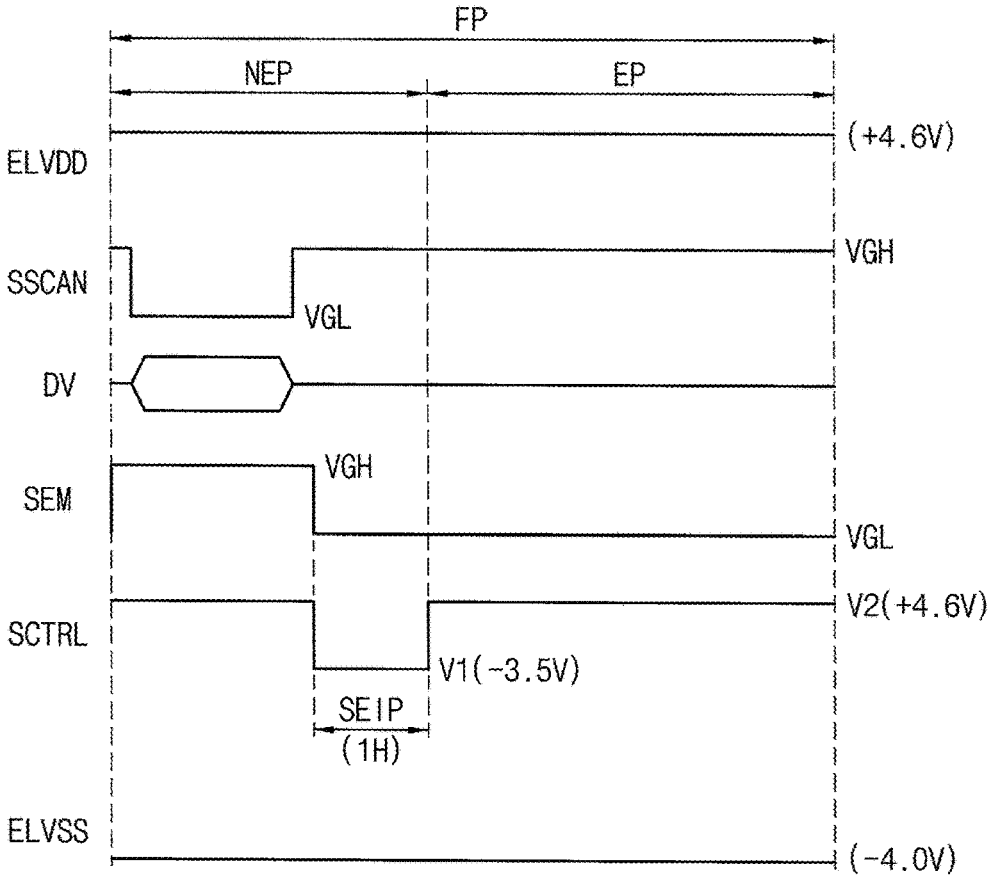
FIG. 6 is a timing diagram for describing an exemplary embodiment of an operation of a pixel of FIG. 4.

FIG. 4 is a circuit diagram illustrating an exemplary embodiment of a pixel of an OLED display device, FIG. 5 is a cross-sectional diagram illustrating an exemplary embodiment of a portion of a pixel of an OLED display device, and FIG. 6 is a timing diagram for describing an exemplary embodiment of an operation of a pixel of FIG. 4.

Referring to FIG. 4, a pixel 100*a* of an OLED display device may include a storage capacitor CSTa, a switching transistor T2, a driving transistor T1*a*, an emission control transistor T6, an OLED EL and a supplemental electrode 110. Referring to FIGS. 4 and 5, the pixel 100*a* of FIG. 4 may have a similar configuration to that of a pixel 100 of FIG. 1, except that a first electrode 255*a* of the storage capacitor CSTa may be connected to a line 290*a* of a first power supply voltage ELVDD, the driving transistor T1*a* also may be connected to the line 290*a* of the first power supply voltage ELVDD, and a supplemental electrode 110 or 210*a* may be directly connected to a line 280*a* of a control signal SCTRL. Referring to FIG. 6, an operation of the pixel 100*a* of FIG. 4 may be similar to the operation of the pixel 100 of FIG. 1 described above with reference to FIG. 3. In some exemplary embodiments, as illustrated in FIG. 6, the first power supply voltage ELVDD may have, but not be limited to, a voltage level of about +4.6V, for example.

Figure 7:
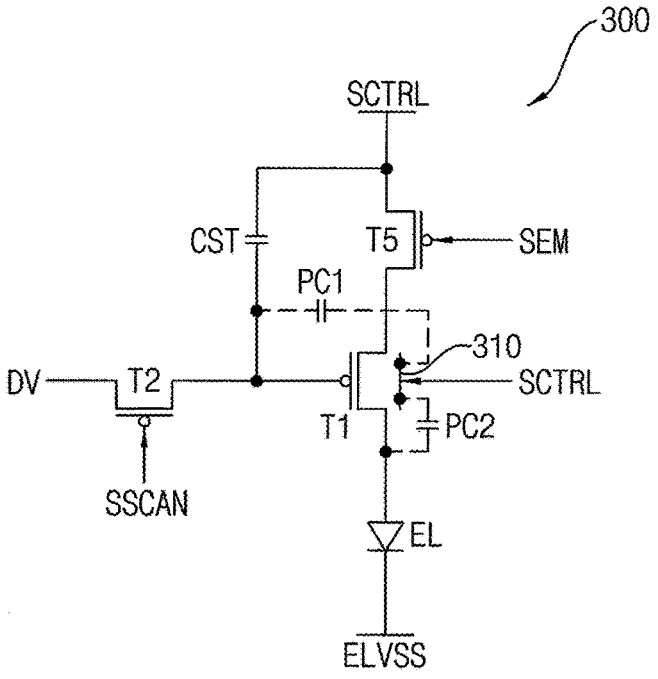
FIG. 7 is a circuit diagram illustrating an exemplary embodiment of a pixel of an OLED display device.

FIG. 7 is a circuit diagram illustrating an exemplary embodiment of a pixel of an OLED display device.

Referring to FIG. 7, a pixel 300 of an OLED display device in an exemplary embodiment may include a storage capacitor CST, a switching transistor T2, a driving transistor T1, an emission control transistor T5, an OLED EL and a supplemental electrode 310. The pixel 300 of FIG. 7 may have a similar configuration and a similar operation to those of a pixel 100 of FIG. 1, except that the pixel 300 of FIG. 7 may include the emission control transistor T5 connected between a line of a control signal SCTRL and the driving transistor T1 instead of an emission control transistor T6 connected between the driving transistor T1 and the OLED EL.

The emission control transistor T5 may selectively form a path for a driving current in response to an emission control signal SEM. In some exemplary embodiments, the emission control transistor T5 may include a gate electrode receiving the emission control signal SEM, a source electrode connected to the line of the control signal SCTRL, and a drain electrode connected to a source electrode of the driving transistor T1.

The supplemental electrode 310 may overlap a gate electrode of the driving transistor T1, and may be connected to the line of the control signal SCTRL to receive the control signal SCTRL. Based on the control signal SCTRL, the supplemental electrode 310 may have a first voltage (e.g., a negative voltage) for a predetermined time period (e.g., a step efficiency improvement period) from a time point at which the emission control signal SEM has a turn-on level, and may have a second voltage (e.g., a positive voltage) after the predetermined time period. Accordingly, step efficiency of the pixel 300 may be prevented.

Figure 8:
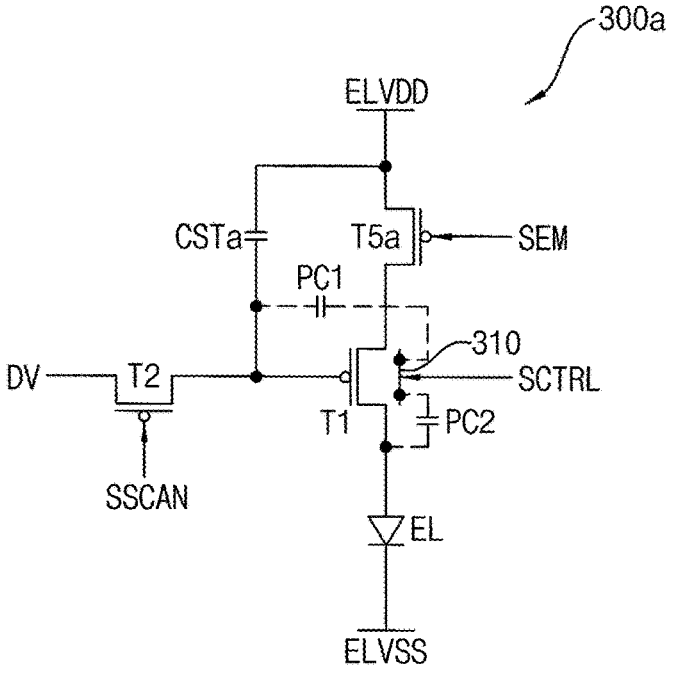
FIG. 8 is a circuit diagram illustrating an exemplary embodiment of a pixel of an OLED display device.

FIG. 8 is a circuit diagram illustrating an exemplary embodiment of a pixel of an OLED display device.

Referring to FIG. 8, a pixel 300*a* of an OLED display device in an exemplary embodiment may include a storage capacitor CSTa, a switching transistor T2, a driving transistor T1, an emission control transistor T5*a*, an OLED EL and a supplemental electrode 310. The pixel 300*a* of FIG. 8 may have a similar configuration to that of a pixel 300 of FIG. 7, except that the storage capacitor CSTa and the emission control transistor T5*a* may be connected to a line of a first power supply voltage ELVDD instead of a line of a control signal SCTRL.

Figure 9:
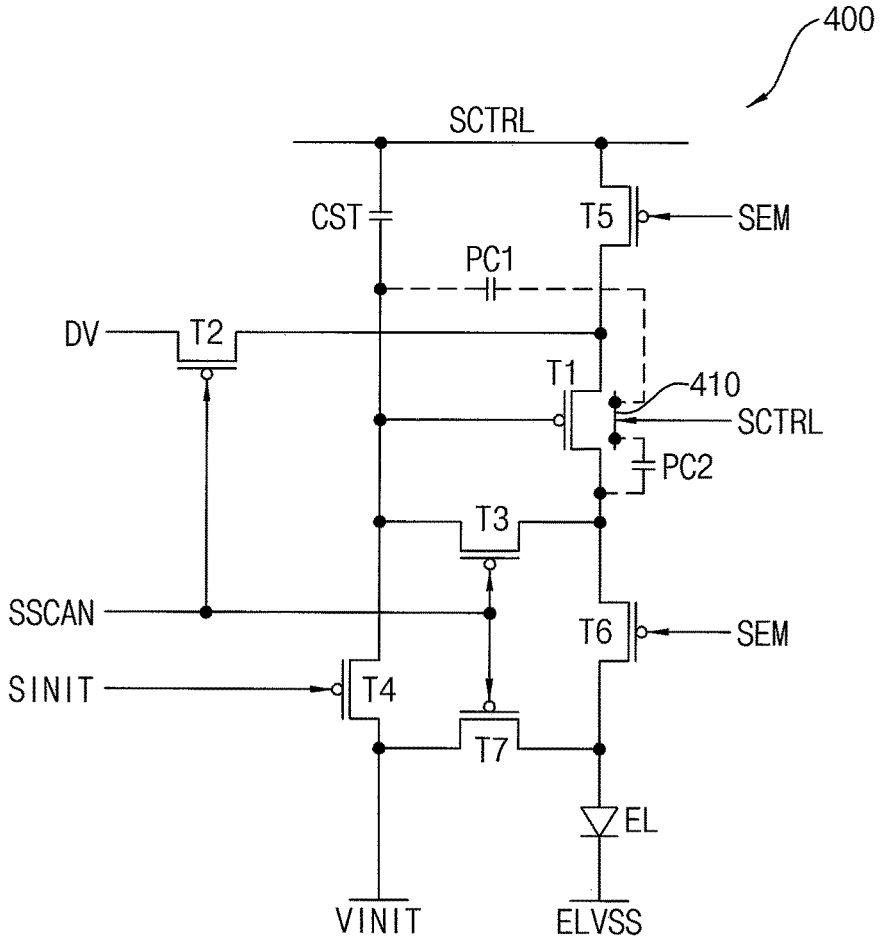
FIG. 9 is a circuit diagram illustrating an exemplary embodiment of a pixel of an OLED display device.
Figure 10:
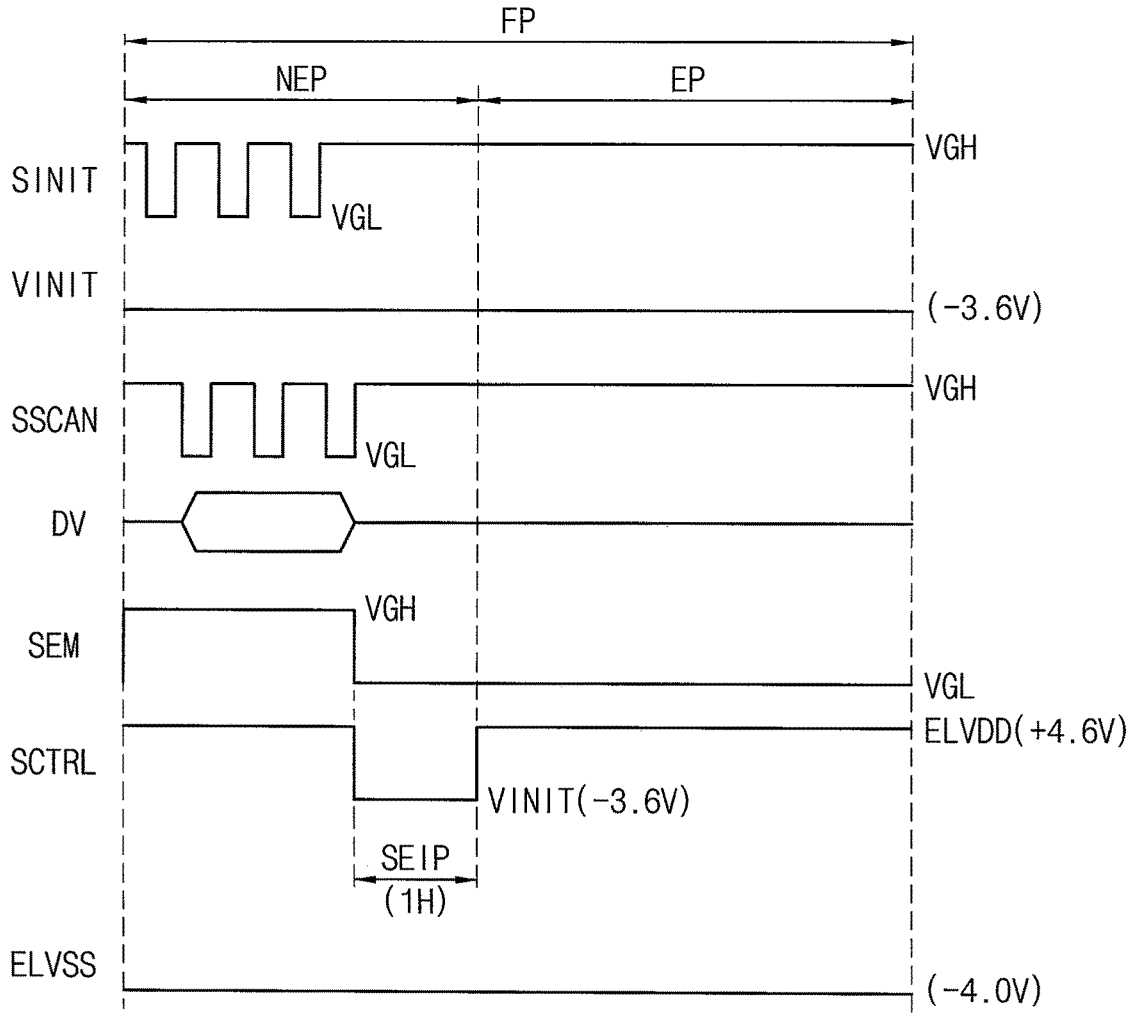
FIG. 10 is a timing diagram for describing an exemplary embodiment of an operation of a pixel of FIG. 9.

FIG. 9 is a circuit diagram illustrating an exemplary embodiment of a pixel of an OLED display device, and FIG. 10 is a timing diagram for describing an exemplary embodiment of an operation of a pixel of FIG. 9.

Referring to FIG. 9, a pixel 400 of an OLED display device in an exemplary embodiment may include a storage capacitor CST, an OLED EL, first through seventh transistors T1 through T7 and a supplemental electrode 410.

The storage capacitor CST may include a first electrode connected to a line of a control signal SCTRL, and a second electrode connected to a gate electrode of the first transistor T1. The OLED EL may include an anode electrode connected to the sixth transistor T6 and the seventh transistor T7, and a cathode electrode connected to a line of a second power supply voltage ELVSS.

The first transistor T1 may include a gate electrode connected to the second electrode of the storage capacitor CST, a source electrode connected to the second transistor T2 and the fifth transistor T5, and a drain electrode connected to the third transistor T3 and the sixth transistor T6. The first transistor T1 may be a driving transistor for generating a driving current.

The second transistor T2 may include a gate electrode receiving a scan signal SSCAN, a source electrode receiving a data voltage DV, and a drain electrode connected to the source electrode of the first transistor T1. The second transistor T2 may be a switching transistor for transferring the data voltage DV in response to the scan signal SSCAN.

The third transistor T3 may include a gate electrode receiving the scan signal SSCAN, a source electrode connected to the drain electrode of the first transistor T1, and a drain electrode connected to the gate electrode of the first transistor T1. The third transistor T3 may be a compensation transistor for diode-connecting the first transistor T1. While the scan signal SSCAN is applied, the data voltage DV transferred by the second transistor T2 may be stored in the storage capacitor CST through the first transistor T1 that is diode-connected by the third transistor T3. Thus, the data voltage DV where a threshold voltage of the first transistor T1 is compensated may be stored in the storage capacitor CST.

The fourth transistor T4 may include a gate electrode receiving an initialization signal SINIT, a source electrode connected to the second electrode of the storage capacitor CST and the gate electrode of the first transistor T1, and a drain electrode connected to a line of an initialization voltage VINIT. The fourth transistor T4 may be a first initialization transistor for initializing the storage capacitor CST and the gate electrode of the first transistor T1 by the initialization voltage VINIT in response to the initialization signal SINIT.

The fifth transistor T5 may include a gate electrode receiving an emission control signal SEM, a source electrode connected to the line of the control signal SCTRL, and a drain electrode connected to the source electrode of the first transistor T1. The fifth transistor T5 may be a first emission control transistor for selectively forming a path for the driving current in response to the emission control signal SEM.

The sixth transistor T6 may include a gate electrode receiving the emission control signal SEM, a source electrode connected to the drain electrode of the first transistor T1, and a drain electrode connected to the anode electrode of the OLED EL. The sixth transistor T6 may be a second emission control transistor for selectively forming the path for the driving current in response to the emission control signal SEM.

The seventh transistor T7 may include a gate electrode receiving the scan signal SSCAN, a source electrode connected to the anode electrode of the OLED EL, and a drain electrode connected to the line of the initialization voltage VINIT. The seventh transistor T7 may be a second initialization transistor for initializing the OLED EL by the initialization voltage VINIT in response to the scan signal SSCAN.

The supplemental electrode 410 may overlap the gate electrode of the first transistor T1, and may be connected to the line of the control signal SCTRL to receive the control signal SCTRL. In some exemplary embodiments, the supplemental electrode 410 may be disposed under the gate electrode of the first transistor T1. Accordingly, the supplemental electrode 410 may block light (e.g., infrared light) output from a light sensor (e.g., an infrared light sensor) under the first transistor T1, and/or may additionally provide the path for the driving current to improve luminance of the OLED EL.

By the supplemental electrode 410, a first parasitic capacitor PC1 may be provided between the supplemental electrode 410 and the gate electrode of the first transistor T1 or the second electrode of the storage capacitor CST, and a second parasitic capacitor PC2 may be provided between the supplemental electrode 410 and an active region of the first transistor T1. By the first and second parasitic capacitors PC1 and PC2, step efficiency that the pixel 400 emits light with luminance lower than desired luminance at a light emission start time point and then emits the light with the desired luminance after a predetermined period of time (e.g., one horizontal time (1H)) may occur.

However, in an exemplary embodiment of the pixel 400, based on the control signal SCTRL, the supplemental electrode 410 may have a first voltage for a predetermined time period (or a step efficiency improvement period) from a time point at which the emission control signal SEM has a turn-on level, and may have a second voltage after the predetermined time period. In some exemplary embodiments, the first voltage may be a negative voltage, and the second voltage may be a positive voltage. In an exemplary embodiment, the first voltage may be the initialization voltage VINIT, and the second voltage may be a first power supply voltage ELVDD, for example.

In an exemplary embodiment, as illustrated in FIG. 10, a frame period FP may include a non-emission period NEP and an emission period EP, for example. In the non-emission period NEP, the emission control signal SEM may have a turn-off level, or a level of a high gate voltage VGH, and the initialization signal SINIT and the scan signal SSCAN may sequentially have a turn-on level, or a level of a low gate voltage VGL. In some exemplary embodiments, as illustrated in FIG. 10, the initialization signal SINIT and the scan signal SSCAN may have the level of the low gate voltage VGL several times. Further, in some exemplary embodiments, as illustrated in FIG. 10, the initialization voltage VINIT may have, but not be limited to, a voltage level of about −3.6V, for example. Subsequently, the initialization signal SINIT and the scan signal SSCAN may have the level of the high gate voltage VGH, and the emission control signal SEM may have the level of the low gate voltage VGL. When the emission control signal SEM has the turn-on level, or the level of the low gate voltage VGL, the control signal SCTRL may have the first voltage, for example, the initialization voltage VINIT of about −3.6V for the step efficiency improvement period SEIP. In some exemplary embodiments, the step efficiency improvement period SEIP may have a time length of one horizontal time or longer.

During the step efficiency improvement period SEIP, since the control signal SCTRL having the initialization voltage VINIT is applied to the supplemental electrode 410, the supplemental electrode 410 also may have the initialization voltage VINIT. Since the supplemental electrode 410 has the initialization voltage VINIT, the first parasitic capacitor PC1 between the supplemental electrode 410 and the gate electrode of the first transistor T1 and the second parasitic capacitor PC2 between the supplemental electrode 410 and the active region of the first transistor T1 may be discharged, and thus effects of the first and second parasitic capacitors PC1 and PC2 may be reduced or eliminated. Further, the threshold voltage of the driving transistor T1 shifted in a positive direction by the first and second parasitic capacitors PC1 and PC2 may be shifted again in a negative direction. Accordingly, after the step efficiency improvement period SEIP, the control signal SCTRL may have the second voltage V2, for example, the first power supply voltage of about +4.6V, for example, and the pixel 400 may emit the light with the desired luminance without the step efficiency. Further, in some exemplary embodiments, as illustrated in FIG. 10, the second power supply voltage ELVSS may have, but not be limited to, a voltage level of about −4.0V, for example.

As described above, in the pixel 400 of the OLED display device, the supplemental electrode 410 overlapping the gate electrode of the first transistor T1 may have the first voltage (e.g., the initialization voltage VINIT) for the predetermined time period, i.e., the step efficiency improvement period SEIP from the time point at which the emission control signal SEM has the turn-on level, and may have the second voltage (e.g., the first power supply voltage ELVDD) after the predetermined time period, i.e., the step efficiency improvement period SEIP. Accordingly, the step efficiency that the pixel 400 emits light with luminance lower than desired luminance at a light emission start time point and then emits the light with the desired luminance after a predetermined period of time may be prevented.

Although FIG. 9 illustrates an example where the supplemental electrode 410 is disposed under the first transistor T1, in some exemplary embodiments, at least one supplemental electrode may be further disposed under at least one of the second through seventh transistors T2 through T7. In an exemplary embodiment, the supplemental electrode may be further disposed under the third transistor T3, for example. Further, in some exemplary embodiments, at least a portion of the first through seventh transistors T1 through T7 may include two or more sub-transistors. In an exemplary embodiment, each of the third and fourth transistors T3 and T4 may include two sub-transistors that are connected in series, for example. In this case, a leakage current through the third and fourth transistors T3 and T4 may be efficiently reduced or prevented.

Figure 11:
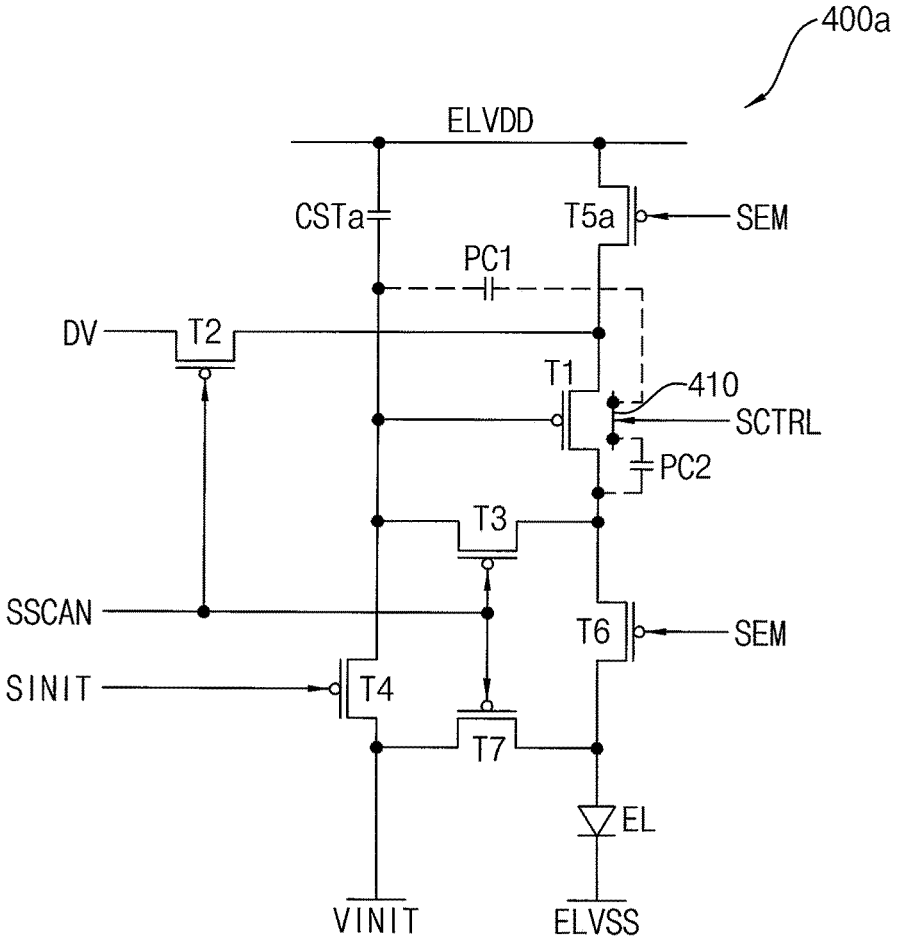
FIG. 11 is a circuit diagram illustrating an exemplary embodiment of a pixel of an OLED display device.
Figure 12:
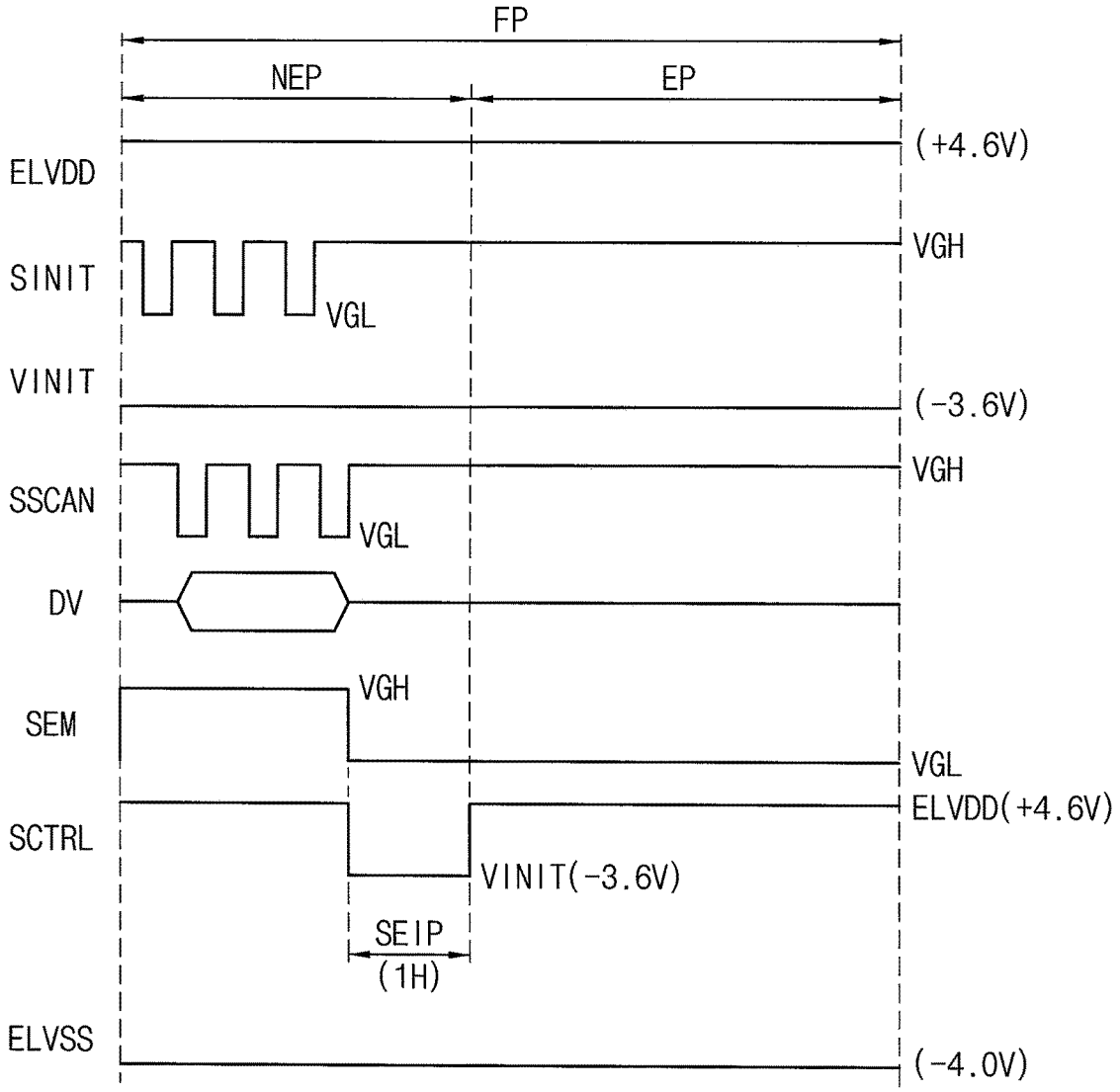
FIG. 12 is a timing diagram for describing an exemplary embodiment of an exemplary embodiment of an operation of a pixel of FIG. 11.

FIG. 11 is a circuit diagram illustrating an exemplary embodiment of a pixel of an OLED display device, and FIG. 12 is a timing diagram for describing an exemplary embodiment of an operation of a pixel of FIG. 11.

Referring to FIG. 11, a pixel 400*a* of an OLED display device may include a storage capacitor CSTa, an OLED EL, first through seventh transistors T1, T2, T3, T4, T5*a*, T6 and T7 and a supplemental electrode 410. The pixel 400*a* of FIG. 11 may have a similar configuration to that of a pixel 400 of FIG. 9, except that the storage capacitor CSTa and the fifth transistor T5*a* may be connected to a line of a first power supply voltage ELVDD instead of a line of a control signal SCTRL. Referring to FIG. 12, an operation of the pixel 400*a* of FIG. 11 may be similar to the operation of the pixel 400 of FIG. 9 described above with reference to FIG. 10. In some exemplary embodiments, as illustrated in FIG. 12, the first power supply voltage ELVDD may have, but not be limited to, a voltage level of about +4.6V, for example.

Figure 13:
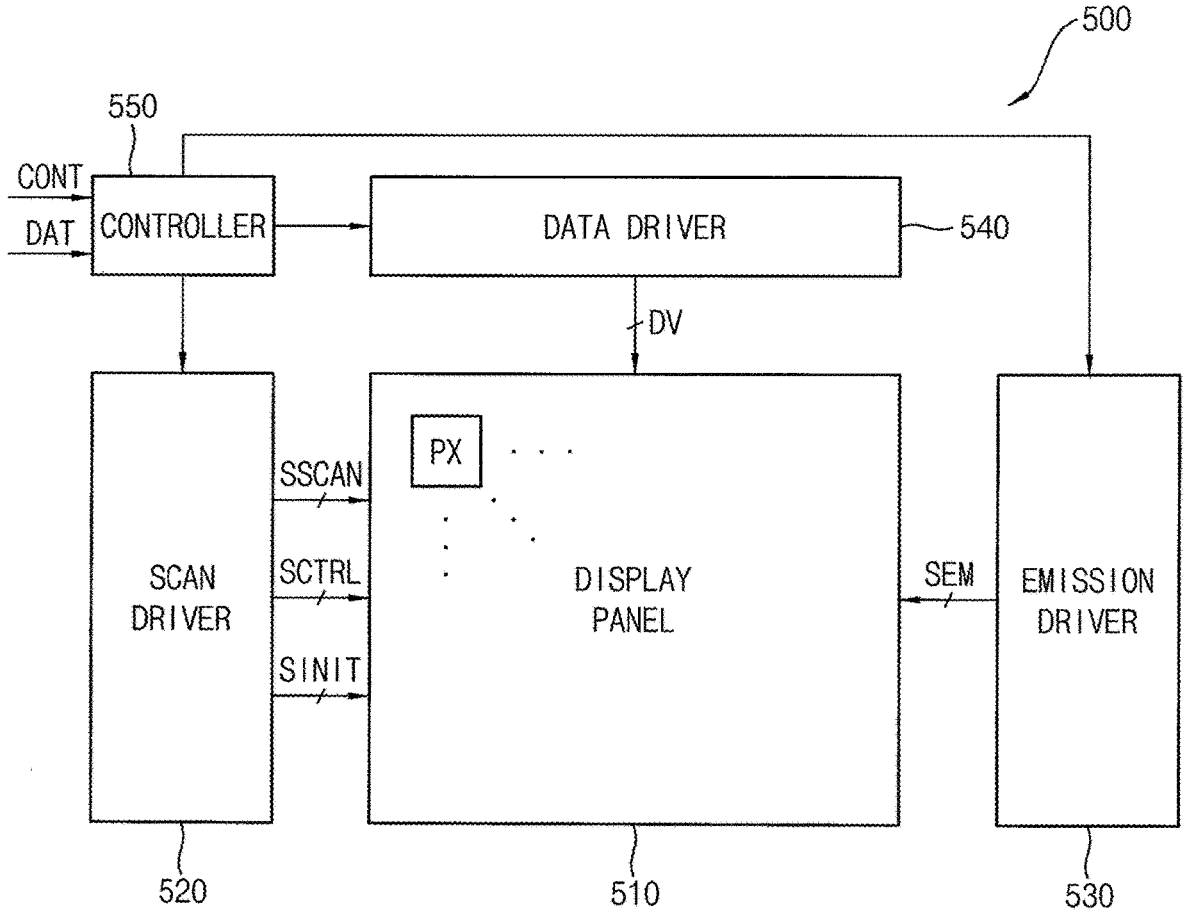
FIG. 13 is a block diagram illustrating an exemplary embodiment of an OLED display device.

FIG. 13 is a block diagram illustrating an exemplary embodiment of an OLED display device.

Referring to FIG. 13, an OLED display device 500 in an exemplary embodiment may include a display panel 510 that includes a plurality of pixels PX, a scan driver 520 that provides a scan signal SSCAN and a control signal SCTRL to the plurality of pixels PX, an emission driver 530 that provides an emission control signal SEM to the plurality of pixels PX, a data driver 540 that provides a data voltage DV to the plurality of pixels PX, and a controller 550 that controls an operation of the OLED display device 500.

The display panel 510 may include a plurality of scan lines, a plurality of control signal lines, a plurality of emission control lines, a plurality of data lines, and the plurality of pixels PX connected to the plurality of scan lines, the plurality of control signal lines, the plurality of emission control lines and the plurality of data lines. In some exemplary embodiments, the display panel 510 may further include a plurality of initialization signal lines. Each pixel PX may include a switching transistor, a storage capacitor, a driving transistor, an emission control transistor, an OLED, and a supplemental electrode which overlaps a gate electrode of the driving transistor and receives the control signal SCTRL. In an exemplary embodiment, each pixel PX may be a pixel 100 having a 3T1C (i.e., three transistors and one capacitor) structure in FIG. 1, a pixel 100*a* having a 3T1C structure in FIG. 4, a pixel 300 having a 3T1C structure in FIG. 7, a pixel 300*a* having a 3T1C structure in FIG. 8, a pixel 400 having a 7T1C (i.e., seven transistors and one capacitor) structure in FIG. 9, a pixel 400*a* having a 7T1C structure in FIG. 11, or the like.

Based on a scan driver control signal received from the controller 550, the scan driver 520 may sequentially provide the scan signal SS to the plurality of pixels PX through the plurality of scan lines on a row-by-row basis, and may provide the control signal SCTRL to the plurality of pixels PX through the plurality of control signal lines. In some exemplary embodiments, the scan driver 520 may sequentially provide the control signal SCTRL to the plurality of pixels PX on a row-by-row basis. In other exemplary embodiments, the control signal SCTRL may be a global signal that is substantially simultaneously provided to the plurality of pixels PX. In some exemplary embodiments, the scan driver control signal may include, but not be limited to, a scan start signal and a scan clock signal. Further, in some exemplary embodiments, the scan driver 520 may sequentially provide an initialization signal SINIT to the plurality of pixels PX through the plurality of initialization signal lines on a row-by-row basis.

The emission driver 530 may provide the emission control signal SEM to the plurality of pixels PX through the plurality of emission control lines based on an emission driver control signal received from the controller 550. In some exemplary embodiments, the emission control signal SEM may be sequentially provided to the plurality of pixels PX on a row-by-row basis. In other exemplary embodiments, the emission control signal SEM may be a global signal that is substantially simultaneously provided to the plurality of pixels PX.

The data driver 540 may provide the data voltage DV to the plurality of pixels PX through the plurality of data lines based on a data driver control signal and image data received from the controller 550. In some exemplary embodiments, the data driver control signal may include, but not be limited to, an output data enable signal, a horizontal start signal and a load signal.

The controller (e.g., a timing controller) 550 may receive image data DAT and an external control signal CONT from an external host processor (e.g., an application processor ("AP"), a graphic processing unit ("GPU") or a graphic card). In some exemplary embodiments, the image data DAT may be, but not be limited to, RGB data including red image data, green image data and blue image data. Further, in some exemplary embodiments, the external control signal CONT provided from the external host processor may include, but not be limited to, a vertical synchronization signal, a horizontal synchronization signal, an input data enable signal, a master clock signal, etc. The controller 550 may control operations of the scan driver 520, the emission driver 530 and the data driver 540 based on the image data DAT and the external control signal CONT.

The control signal SCTRL applied to each pixel PX may have a first voltage for a predetermined time period from a time point at which the emission control signal SEM has a turn-on level, and may have a second voltage after the predetermined time period. In some exemplary embodiments, the first voltage may be a voltage for reducing or eliminating an effect of a first parasitic capacitor between the supplemental electrode and the gate electrode of the driving transistor and an effect of a second parasitic capacitor between the supplemental electrode and an active region of the driving transistor. In some exemplary embodiments, the first voltage may be an initialization voltage, and the second voltage may be a power supply voltage (e.g., a high power supply voltage). Accordingly, step efficiency that the pixel PX emits light with luminance lower than desired luminance at a light emission start time point and then emits the light with the desired luminance after a predetermined period of time may be prevented.

Figure 14:
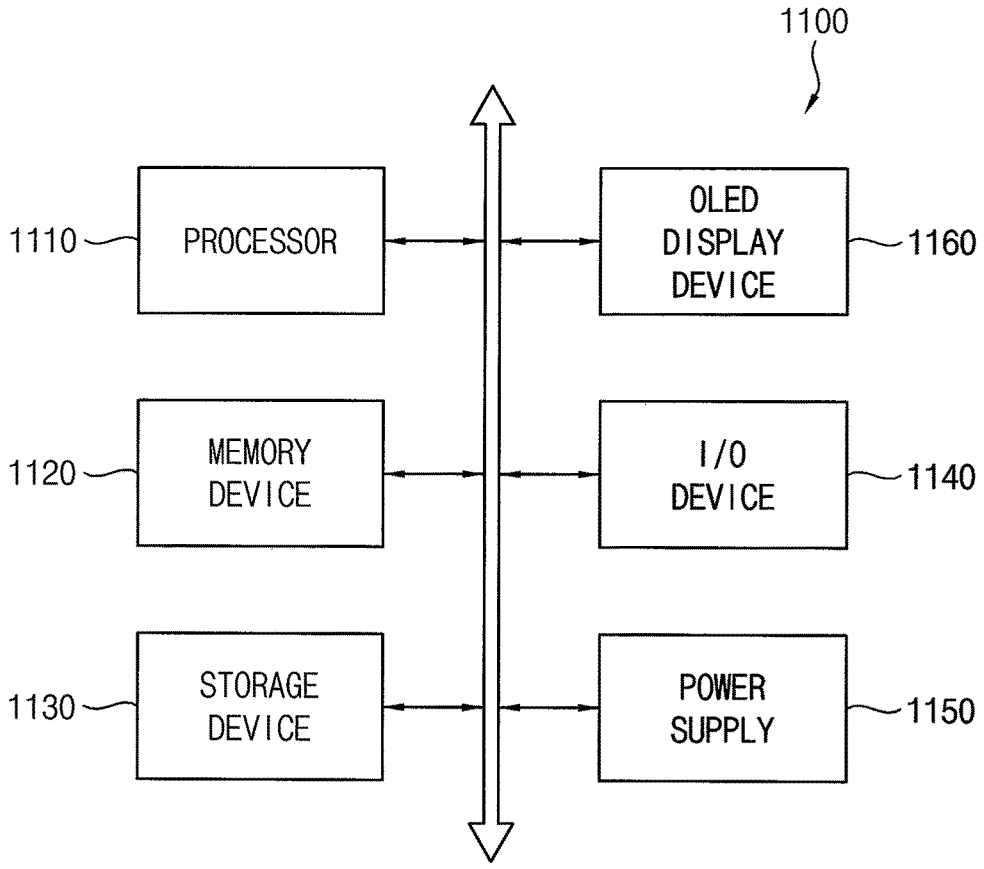
FIG. 14 is an exemplary embodiment of an electronic device including an OLED display device.

FIG. 14 is an exemplary embodiment of an electronic device including an OLED display device.

Referring to FIG. 14, an electronic device 1100 may include a processor 1110, a memory device 1120, a storage device 1130, an input/output ("I/O") device 1140, a power supply 1150 and an OLED display device 1160. In an exemplary embodiment, the electronic device 1100 may further include a plurality of ports for communicating a video card, a sound card, a memory card, a universal serial bus ("USB") device, other electric devices, etc.

The processor 1110 may perform various computing functions or tasks. In an exemplary embodiment, the processor 1110 may be an AP, a micro-processor, a central processing unit ("CPU"), etc. The processor 1110 may be coupled to other components via an address bus, a control bus, a data bus, etc. Further, in some exemplary embodiments, the processor 1110 may be further coupled to an extended bus such as a peripheral component interconnection ("PCI") bus.

The memory device 1120 may store data for operations of the electronic device 1100. In an exemplary embodiment, the memory device 1120 may include at least one non-volatile memory device such as an erasable programmable read-only memory ("EPROM") device, an electrically erasable programmable read-only memory ("EEPROM") device, a flash memory device, a phase change random access memory (PRAM) device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc.

The storage device 1130 may be a solid state drive ("SSD") device, a hard disk drive ("HDD") device, a CD-ROM device, etc. In an exemplary embodiment, the I/O device 1140 may be an input device such as a keyboard, a keypad, a mouse, a touch screen, etc., and an output device such as a printer, a speaker, etc. The power supply 1150 may supply power for operations of the electronic device 1100. The OLED display device 1160 may be coupled to other components through the buses or other communication links.

In each pixel of the OLED display device 1160, a supplemental electrode overlapping a gate electrode of a driving transistor may have a first voltage for a predetermined time period from a time point at which an emission control signal has a turn-on level, and may have a second voltage after the predetermined time period. Accordingly, step efficiency that the pixel emits light with luminance lower than desired luminance at a light emission start time point and then emits the light with the desired luminance after a predetermined period of time may be prevented.

The exemplary embodiments of invention may be applied to any OLED display device 1160, and any electronic device 1100 including the OLED display device 1160. In an exemplary embodiment, the inventions may be applied to a mobile phone, a smart phone, a wearable electronic device, a tablet computer, a television ("TV"), a digital TV, a three dimensional ("3D") TV, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A pixel of an organic light emitting diode display device, the pixel comprising:

a switching transistor which transfers a data voltage;

a storage capacitor which stores the data voltage transferred by the switching transistor;

a driving transistor which generates a driving current based on the data voltage stored in the storage capacitor;

an emission control transistor which selectively forms a path for the driving current in response to an emission control signal;

an organic light emitting diode which emits light based on the driving current; and a supplemental electrode which overlaps a gate electrode of the driving transistor, the supplemental electrode having a first voltage for a predetermined time period from a time point at which the emission control signal has a turn-on level, and having a second voltage after the predetermined time period.

2. The pixel of claim 1, wherein the first voltage is a voltage which reduces an effect of a first parasitic capacitor between the supplemental electrode and the gate electrode of the driving transistor and an effect of a second parasitic capacitor between the supplemental electrode and an active region of the driving transistor.

3. The pixel of claim 1, wherein the first voltage is a voltage which shifts a threshold voltage of the driving transistor in a negative direction.

4. The pixel of claim 1, wherein the first voltage is a negative voltage, and the second voltage is a positive voltage.

5. The pixel of claim 1, wherein the predetermined time period has a time length of one horizontal time.

6. The pixel of claim 1, wherein the storage capacitor includes a first electrode connected to a line of a control signal, and a second electrode, wherein the driving transistor includes the gate electrode connected to the second electrode of the storage capacitor, a source electrode, and a drain electrode, wherein the switching transistor includes a gate electrode which receives a scan signal, a source electrode which receives the data voltage, and a drain electrode connected to the second electrode of the storage capacitor, and wherein the supplemental electrode is disposed under the gate electrode of the driving transistor, and is connected to the line of the control signal.

7. The pixel of claim 6, wherein the control signal has the first voltage for the predetermined time period, and has the second voltage after the predetermined time period.

8. The pixel of claim 6, wherein the emission control transistor includes a gate electrode which receives the emission control signal, a source electrode connected to the drain electrode of the driving transistor, and a drain electrode connected to the organic light emitting diode.

9. The pixel of claim 6, wherein the emission control transistor includes a gate electrode which receives the emission control signal, a source electrode connected to the line of the control signal, and a drain electrode connected to the source electrode of the driving transistor.

10. The pixel of claim 1, wherein the storage capacitor includes a first electrode connected to a line of a power supply voltage, and a second electrode, wherein the driving transistor includes the gate electrode connected to the second electrode of the storage capacitor, a source electrode, and a drain electrode, wherein the switching transistor includes a gate electrode which receives a scan signal, a source electrode which receives the data voltage, and a drain electrode connected to the second electrode of the storage capacitor, and wherein the supplemental electrode is disposed under the gate electrode of the driving transistor, and is connected to a line of a control signal.

11. The pixel of claim 1, wherein the storage capacitor includes a first electrode connected to a line of a control signal, and a second electrode, wherein the driving transistor includes:

a first transistor including the gate electrode connected to the second electrode of the storage capacitor, a source electrode, and a drain electrode, wherein the switching transistor includes:

a second transistor including a gate electrode which receives a scan signal, a source electrode which receives the data voltage, and a drain electrode connected to the source electrode of the first transistor, wherein the emission control transistor includes:

a third transistor including a gate electrode which receives the emission control signal, a source electrode connected to the line of the control signal, and a drain electrode connected to the source electrode of the first transistor; and a fourth transistor including a gate electrode which receives the emission control signal, a source electrode connected to the drain electrode of the first transistor, and a drain electrode connected to the organic light emitting diode, and wherein the supplemental electrode is disposed under the gate electrode of the first transistor, and is connected to the line of the control signal.

12. The pixel of claim 11, further comprising:

a fifth transistor including a gate electrode which receives the scan signal, a source electrode connected to the drain electrode of the first transistor, and a drain electrode connected to the gate electrode of the first transistor;

a sixth transistor including a gate electrode which receives an initialization signal, a source electrode connected to the second electrode of the storage capacitor, and a drain electrode connected to a line of an initialization voltage; and a seventh transistor including a gate electrode which receives the scan signal, a source electrode connected to the organic light emitting diode, and a drain electrode connected to the line of the initialization voltage.

13. The pixel of claim 1, wherein the storage capacitor includes a first electrode connected to a line of a power supply voltage, and a second electrode, wherein the driving transistor includes:

a first transistor including the gate electrode connected to the second electrode of the storage capacitor, a source electrode, and a drain electrode, wherein the switching transistor includes:

a second transistor including a gate electrode which receives a scan signal, a source electrode which receives the data voltage, and a drain electrode connected to the source electrode of the first transistor, wherein the emission control transistor includes:

a fifth transistor including a gate electrode which receives the emission control signal, a source electrode connected to the line of the power supply voltage, and a drain electrode connected to the source electrode of the first transistor; and a sixth transistor including a gate electrode which receives the emission control signal, a source electrode connected to the drain electrode of the first transistor, and a drain electrode connected to the organic light emitting diode, wherein the supplemental electrode is disposed under the gate electrode of the first transistor, and is connected to a line of a control signal, and wherein the pixel further comprises:

a third transistor including a gate electrode which receives the scan signal, a source electrode connected to the drain electrode of the first transistor, and a drain electrode connected to the gate electrode of the first transistor;

a fourth transistor including a gate electrode which receives an initialization signal, a source electrode connected to the second electrode of the storage capacitor, and a drain electrode connected to a line of an initialization voltage; and a seventh transistor including a gate electrode which receives the scan signal, a source electrode connected to the organic light emitting diode, and a drain electrode connected to the line of the initialization voltage.

14. A pixel of an organic light emitting diode display device, the pixel comprising:

an organic light emitting diode including an anode electrode, and a cathode electrode connected to a line of a second power supply voltage;

a storage capacitor including a first electrode connected to a line of a control signal, and a second electrode;

a first transistor including a gate electrode connected to the second electrode of the storage capacitor, a source electrode, and a drain electrode;

a second transistor including a gate electrode which receives a scan signal, a source electrode which receives a data voltage, and a drain electrode connected to the source electrode of the first transistor;

a third transistor including a gate electrode which receives the scan signal, a source electrode connected to the drain electrode of the first transistor, and a drain electrode connected to the gate electrode of the first transistor;

a fourth transistor including a gate electrode which receives an initialization signal, a source electrode connected to the second electrode of the storage capacitor, and a drain electrode connected to a line of an initialization voltage;

a fifth transistor including a gate electrode which receives an emission control signal, a source electrode connected to the line of the control signal, and a drain electrode connected to the source electrode of the first transistor;

a sixth transistor including a gate electrode which receives the emission control signal, a source electrode connected to the drain electrode of the first transistor, and a drain electrode connected to the anode electrode of the organic light emitting diode;

a seventh transistor including a gate electrode which receives the scan signal, a source electrode connected to the anode electrode of the organic light emitting diode, and a drain electrode connected to the line of the initialization voltage; and a supplemental electrode which overlaps the gate electrode of the first transistor, and is connected to the line of the control signal, wherein the control signal has a first voltage for a predetermined time period from a time point at which the emission control signal has a turn-on level, and has a second voltage after the predetermined time period.

15. The pixel of claim 14, wherein the first voltage is a voltage which reduces an effect of a first parasitic capacitor between the supplemental electrode and the gate electrode of the first transistor and an effect of a second parasitic capacitor between the supplemental electrode and an active region of the first transistor.

16. The pixel of claim 14, wherein the first voltage is a voltage which shifts a threshold voltage of the first transistor in a negative direction.

17. The pixel of claim 14, wherein the first voltage is a negative voltage, and the second voltage is a positive voltage.

18. The pixel of claim 14, wherein the first voltage is the initialization voltage, and the second voltage is a first power supply voltage.

19. The pixel of claim 14, wherein the predetermined time period has a time length of one horizontal time.

20. An organic light emitting diode display device comprising:

a display panel including a plurality of pixels;

a data driver which provides a data voltage to the plurality of pixels;

a scan driver which provides a scan signal and a control signal to the plurality of pixels; and an emission driver which provides an emission control signal to the plurality of pixels, wherein each of the plurality of pixels includes a switching transistor, a storage capacitor, a driving transistor, an emission control transistor, an organic light emitting diode, and a supplemental electrode which overlaps a gate electrode of the driving transistor and receives the control signal, and wherein the control signal has a first voltage for a predetermined time period from a time point at which the emission control signal has a turn-on level, and has a second voltage after the predetermined time period.

* * * * *